US010100547B1

(12) United States Patent
Baldwin, III et al.

(10) Patent No.: US 10,100,547 B1
(45) Date of Patent: Oct. 16, 2018

(54) BALLISTIC PROTECTION SHELTER

(71) Applicants: James E. Baldwin, III, La Porte, TX (US); John Everette Dunning, III, La Porte, TX (US)

(72) Inventors: James E. Baldwin, III, La Porte, TX (US); John Everette Dunning, III, La Porte, TX (US)

( * ) Notice: Subject to any disclaimer, the term of this patent is extended or adjusted under 35 U.S.C. 154(b) by 0 days.

(21) Appl. No.: 15/710,171

(22) Filed: Sep. 20, 2017

(51) Int. Cl.

| | |
|---|---|
| ***E04C 2/32*** | (2006.01) |
| ***E04H 9/10*** | (2006.01) |
| ***F41H 5/24*** | (2006.01) |
| *E04H 15/34* | (2006.01) |

(52) U.S. Cl.
CPC ..... *E04H 9/10* (2013.01); *F41H 5/24* (2013.01); *E04H 15/34* (2013.01)

(58) Field of Classification Search
CPC ..... E04H 9/10; E04H 15/34; F41H 5/24
USPC ..... 52/783.1; 89/36.02
See application file for complete search history.

(56) References Cited

U.S. PATENT DOCUMENTS 2,878,665 A * 3/1959 Crabbe ..... E04H 9/10 109/1 S
7,600,348 B1 * 10/2009 Kostka ..... E04H 9/10 135/97
2009/0272415 A1 * 11/2009 Zepeda ..... E04H 15/34 135/130
2011/0023759 A1 * 2/2011 Waller ..... F41H 5/24 109/79
2011/0203629 A1 * 8/2011 Smith ..... E04H 15/001 135/121
2012/0090455 A1 * 4/2012 Duncan ..... E04H 9/10 89/36.07
2012/0186165 A1 * 7/2012 Wilsey ..... E04B 1/161 52/63
2013/0047829 A1 * 2/2013 Heselden ..... E04B 1/3205 89/36.02
2013/0340603 A1 * 12/2013 Johnson ..... F41H 5/24 89/36.02
2015/0136191 A1 * 5/2015 Carbaugh ..... E04B 1/3441 135/120.3
2015/0315808 A1 * 11/2015 Cronk ..... E04H 15/34 135/121
2015/0322686 A1 * 11/2015 Harper ..... E04B 1/24 52/481.1

* cited by examiner

*Primary Examiner* — Basil S Katcheves
(74) *Attorney, Agent, or Firm* — Buskop Law Group, P.C.; Wendy Buskop

(57) ABSTRACT

A ballistic protection shelter with a plurality of spring loaded leg assemblies, a plurality of beams each beam having a curved apex, a pair of top engagement grooves, and a pair of bottom engagement grooves. The shelter includes a plurality of spring loaded purlin assemblies connected between pairs of beams and both an inside and an outside contiguous layer of ballistic protection material, each contiguous layer connected in parallel between pairs of beams providing the appearance of a structure. The ballistic protection material is adapted to provide protection to shelter occupants against blast overpressure, resulting from explosive detonations and shrapnel.

10 Claims, 14 Drawing Sheets

BALLISTIC PROTECTION SHELTER

CROSS-REFERENCE TO RELATED APPLICATIONS

The present application claims priority to U.S. Provisional Patent Application Ser. No. 62/397,886, filed on Sep. 21, 2016, for "Ballistic Protection Shelter."

FIELD

The present embodiments generally relate to a ballistic protection shelter.

BACKGROUND

A need exists for a quick to assemble ballistic protection shelter that can protect occupants from destructive energy waves resulting in structural damage and shrapnel projected from multiple directions simultaneously.

A further need exists for a rugged and sturdy structure that can provide protection without collapsing.

The present embodiments meet these needs.

BRIEF DESCRIPTION OF THE DRAWINGS

The detailed description will be better understood in conjunction with the accompanying drawings as follows.

Figure 1A:
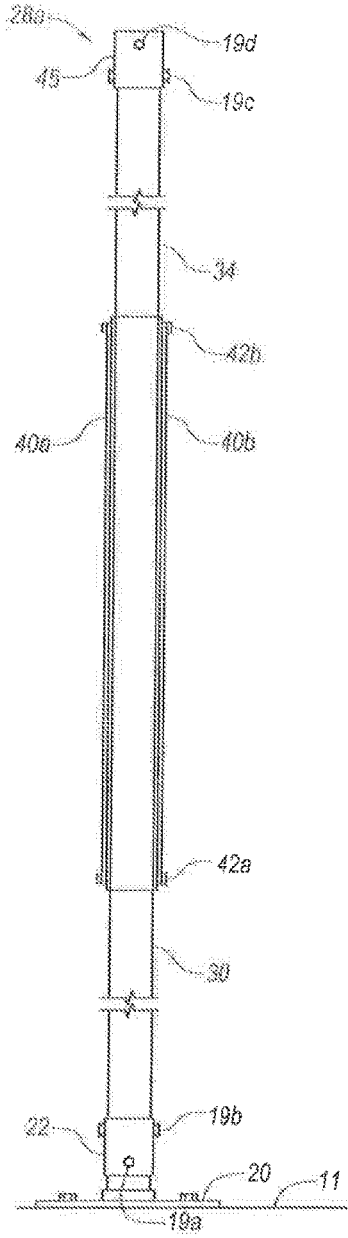
FIGS. 1A-1G depict a spring loaded leg assembly according to one or more embodiments.
Figure 1B:
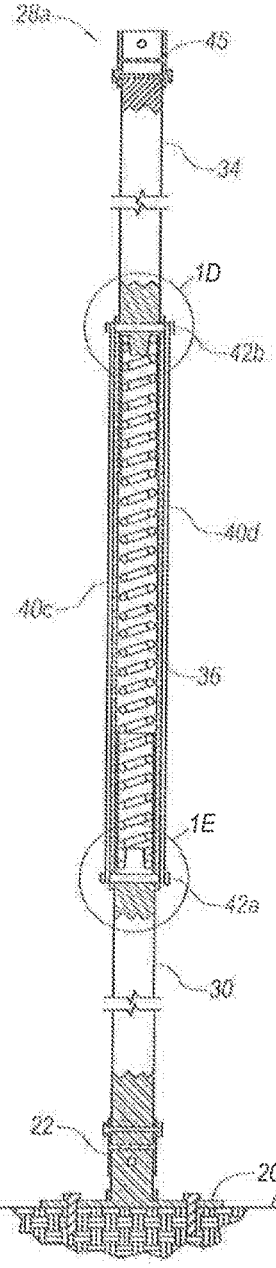
Figure 1C:
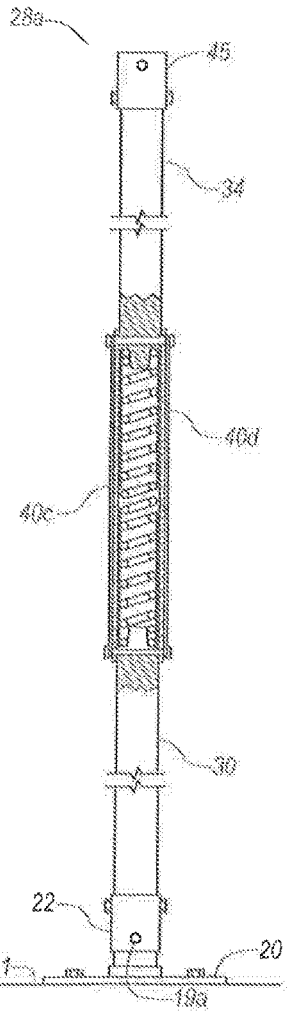
Figure 1D:
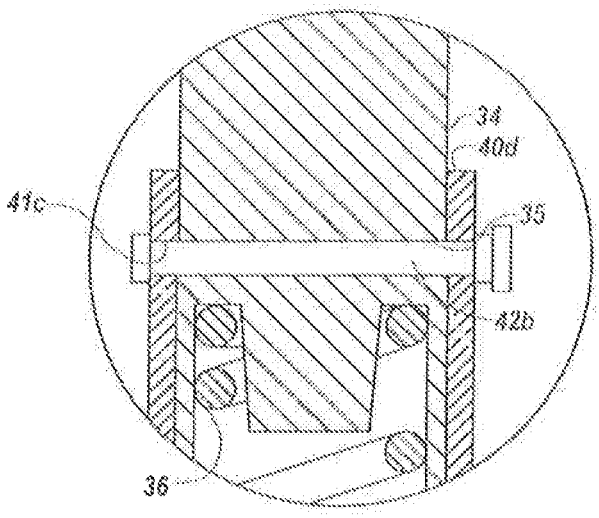
Figure 1E:
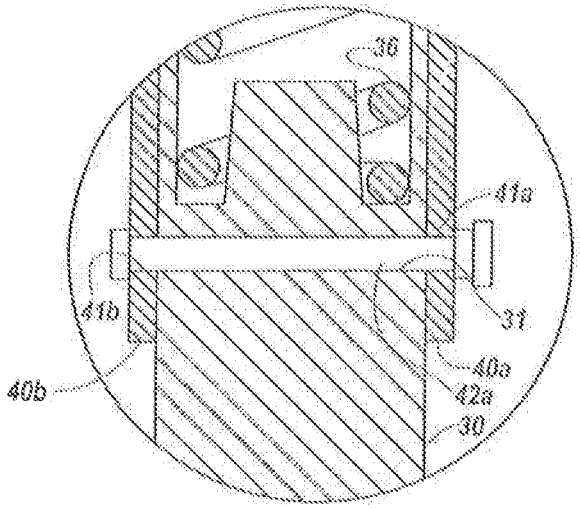
Figure 1F:
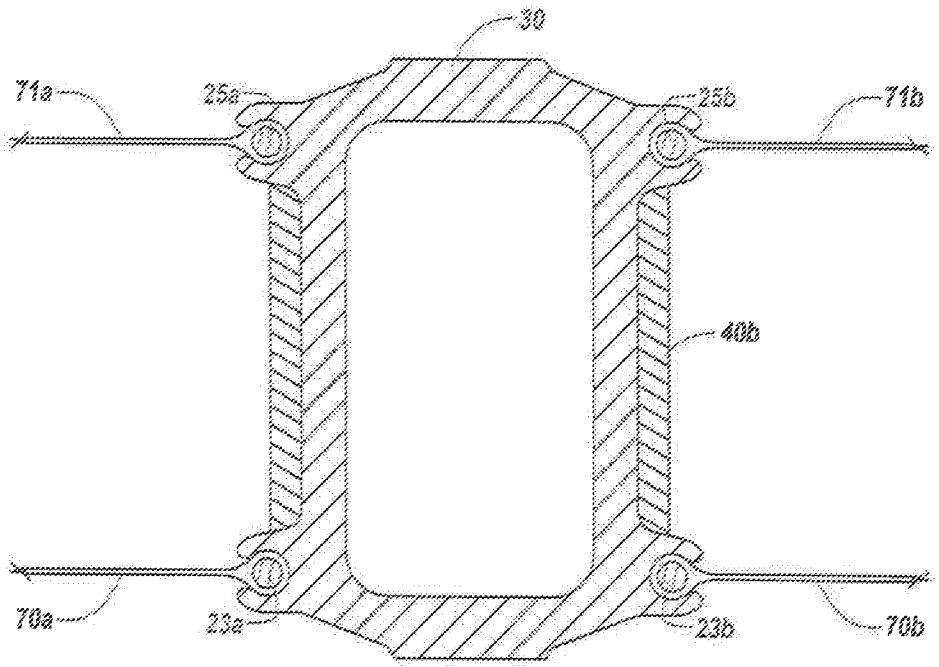
Figure 1G:
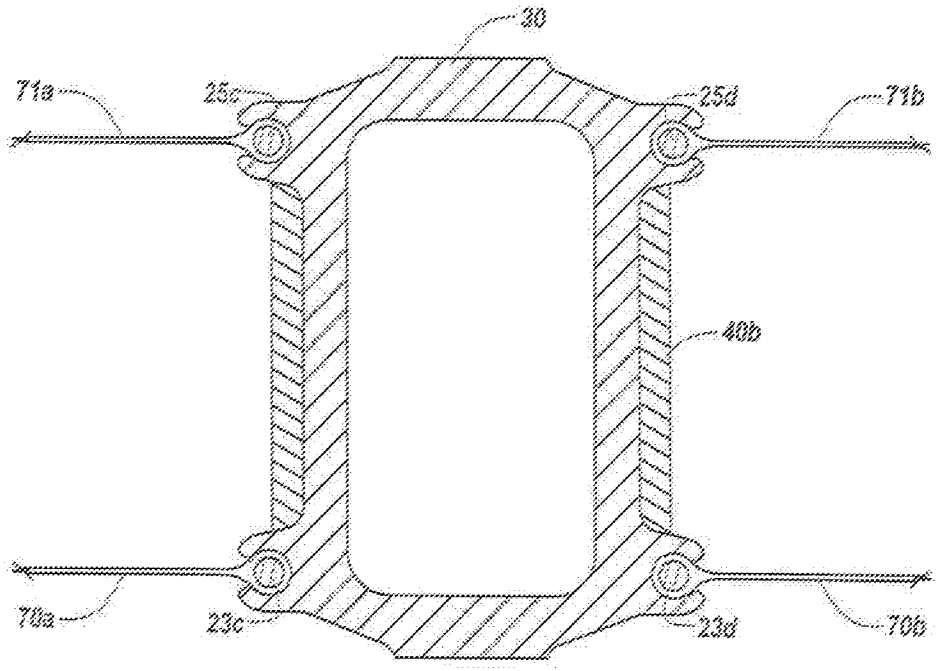
Figure 2A:
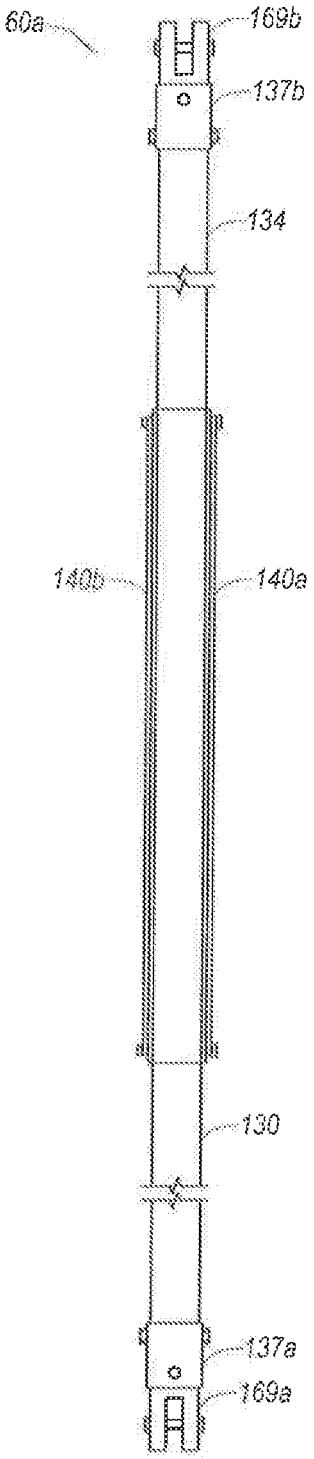
FIGS. 2A-2E depict a spring loaded purlin assembly according to one or more embodiments.
Figure 2B:
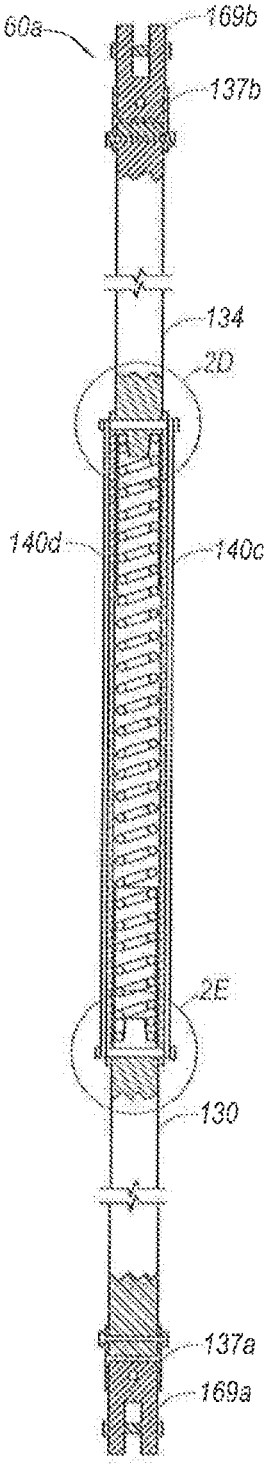
Figure 2C:
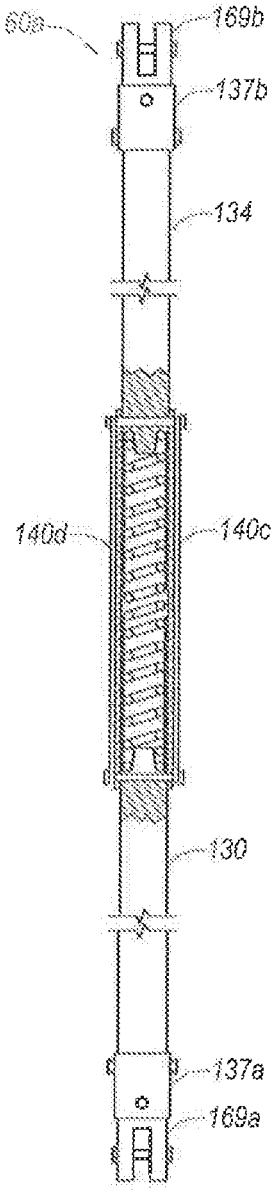
Figure 2D:
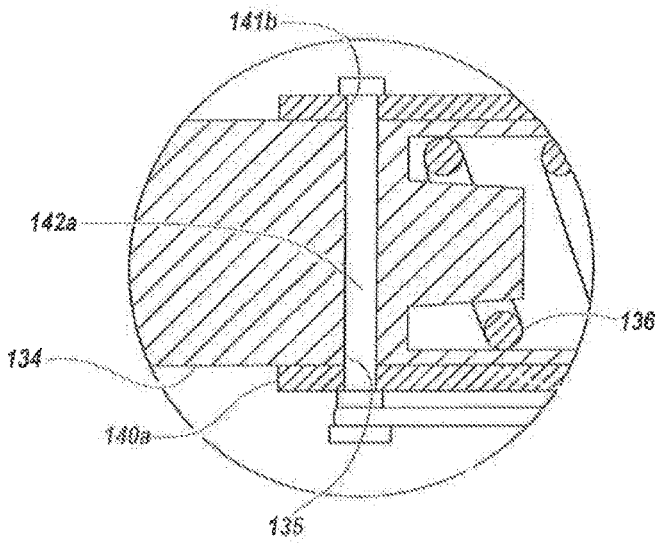
Figure 2E:
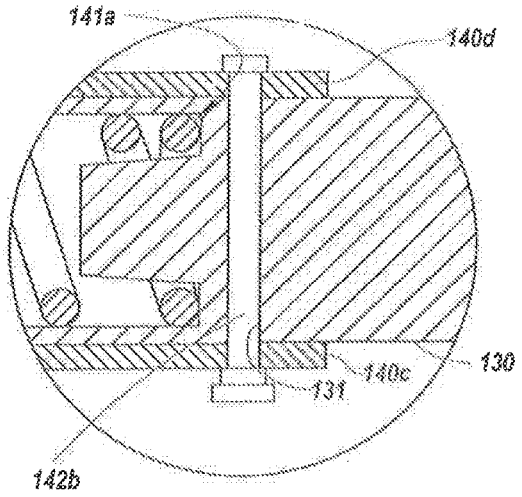

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relate to a ballistic protection shelter to adaptively provide protection to occupants from over blast pressure due to detonations and the resulting energy waves and shrapnel.

The invention, which is portable, easy to transport, and quickly assembled and disassembled, saves lives from the effects of detonations, which could be controlled blasts from mining operations.

A ballistic protection shelter comprises spring loaded leg assemblies. Each spring loaded leg assembly is configured to mount to a surface. Each spring loaded leg assembly comprises a base plate.

A first bracket 22 is connected to the base plate.

A first hollow beam engages the first bracket. The first hollow beam has a pair of inner leg grooves and a pair of outer leg grooves.

A second hollow beam has a pair of inner leg grooves and a pair of outer leg grooves. The second hollow beam is movable from a flush mounted position to a disengaged position with the first hollow beam.

A leg spring is contained in a portion of the first hollow beam and a portion of the second hollow beam with an end of the leg spring connected to each hollow beam.

A plurality of leg impact protectors is mounted to surround the portions of each hollow beam containing the leg spring.

A second bracket is connected to the second hollow beam opposite the first hollow beam, wherein the first hollow beam and the second hollow beam compress the leg spring when the spring loaded leg assemblies are impacted by blast overpressure, resulting from explosive detonations and shrapnel.

The ballistic protection shelter comprises beams. Each beam is connected to the second bracket of one of the spring loaded leg assemblies. Each beam comprises, a pair of base curves, a roof curve forming a curved apex, and a pair of long straight members, a pair of top engagement grooves, and a pair of bottom engagement grooves.

Each long straight member is connected between one of the pair of base curves and the roof curve.

A plurality of spring loaded purlin assemblies is connected between the beams.

The ballistic protection shelter comprises a plurality of inside contiguous layers of ballistic protection material. The plurality of inside contiguous layers of ballistic protection material is connected in sequence. Each inside contiguous layer of ballistic protection material is connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure.

The ballistic protection shelter comprises a plurality of outside contiguous layers of ballistic protection material. The plurality of outside contiguous layers of ballistic protection material is connected in sequence. Each outside contiguous layer is mounted over the inner structure. Each outside contiguous layer is connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure. The inner and outer structures together form the ballistic protection shelter providing protection to shelter occupants against the blast overpressure, resulting from explosive detonations and shrapnel.

Turning now to the Figures, FIGS. 1A-1G depict a spring loaded leg assembly 28*a* according to one or more embodiments.

The ballistic protection shelter can have a plurality of spring loaded leg assemblies 28*a*. Each spring loaded leg assembly 28*a* can be configured to mount to a surface 11, such as a concrete foundation on into the ground.

In embodiments, pairs of spring loaded leg assemblies can support a single beam, which embodiments can be curved.

Each spring loaded leg assembly can have a base plate 20. The base plate can be made of steel, such as a 2 foot by 2 foot plate.

Each spring loaded leg assembly can have a first bracket 22. The first bracket can be a hollow bracket connected to the base plate 20 through a first hole in the first bracket such as with a first bracket fastener 19*a*.

Each spring loaded leg assembly can have a first hollow beam 30 that fits into the first bracket 22.

The first hollow beam 30 can have a pair of inner leg grooves 23*a* and 23*b* and a pair of outer leg grooves 25*a* and 25*b*.

The inner leg grooves can secure to a pair of inside contiguous layer of ballistic protection material 70*a*, and 70*b*. The outer leg grooves can secure to a pair of outside contiguous layer of ballistic protection material 71*a*, and 71*b*.

A second bracket fastener 19*b* can secure through a first hole in the first hollow beam 30 and a second hole in the first bracket 22 to hold the first hollow beam 30 to the first bracket 22.

In embodiments, the first hollow beam 30 can have a second hole 31 opposite the first hole which can engage a first spring fastener 42*a*.

The spring loaded leg assembly 28*a* can have a second hollow beam 34. The second hollow beam 34 can have a pair of inner leg grooves 23*c* and 23*d* and a pair of outer leg grooves 25*c* and 25*d*.

In embodiments, the second hollow beam 34 can be movable from a flush mounted position with the first hollow beam 30 to a disengaged position with the first hollow beam 30.

The second hollow beam 34 has a first hole through which a third bracket fastener 19*c* can be secured to hold the second hollow beam 34 to a second bracket which is positioned opposite the first hollow beam.

The second hollow beam 34 can have a second hole 35 through which a second spring fastener 42*b* can be secured.

A fourth bracket fastener 19*d* can secure the second bracket to an additional component, such as a beam.

In embodiments, a leg spring 36 can be simultaneously contained in a portion of the first hollow beam 30 and a portion of the second hollow beam 34 with an end of the leg spring 36 connected to each hollow beam.

In embodiments, a first spring end can connect to the first hollow beam 30 with the first spring fastener 42*a*. A second spring can connect to the second hollow beam 34 with the second spring fastener 42*b*.

A plurality of leg impact protectors 40*a*-40*d* can be mounted to surround the portions of each hollow beam containing the leg spring 36.

Between two and four leg impact protectors can surround portions of each hollow beam 30, 34 that contain the leg spring 36.

Each leg impact protector 40*a*-40*d* can be from 1 to 3 feet in length and from 1 to 5 inches in width. Each leg impact protector 40*a*-40*d* can be bolted to the hollow beam 30, 34 and made from a thermoplastic material or rubber.

Each leg impact protector can have a plurality of impact protector holes aligning with the first and second hollow beam holes enabling fasteners to secure the leg impact protectors to the hollow beams.

Since the second hollow beam is positioned opposite the first hollow beam, the first hollow beam and the second hollow beam compress together, compressing the leg spring when the spring loaded leg assembly is impacted provide protection to people inside the structure due to blast overpressure, resulting from explosive detonations and shrapnel.

It should be noted that the first hollow beam holes and the second hollow beam holes can have diameters ranging from one-fourth of an inch to three-fourth of an inch.

The first hollow beam holes and the second hollow beam holes can be positioned 1.5 inches to 5 inches from an end of each hollow beam.

The leg spring 36 in embodiments, can not only be simultaneously contained in a portion of the first hollow beam 30 and a portion of the second hollow beam 34 but when assembled, the leg spring can then sustain forces from 100 ft/lbs to 2000 ft/lbs.

In embodiments, the leg spring 36 can be made from carbon steel and can range in length from 12 inches to 48 inches.

The leg spring 36 can have from 10 active coils to 50 active coils in total for each spring loaded leg assembly 28*a*.

In embodiments, the plurality of leg impact protectors 40*a*-40*d* can be made from an elastomeric material or aluminum or steel which has a different in physical property from the material used for the hollow beams.

In embodiments, the plurality of leg impact protectors 40*a*-40*d* can a wall thickness ranging from one-sixteenth of an inch to three-fourths of an inch.

The first leg impact protector holes can be positioned 1.5 inches to 5 inches from an end of each of the plurality of leg impact protectors 40*abcd*.

In embodiments, the first fastener 42*a*, such as a bolt, can engage the first end of the leg spring 36 through an aligned leg impact protector hole and a first hollow beam hole.

In embodiments, a second fastener 42*b*, such as a bolt, can engage the second end of the leg spring 36 through the aligned leg impact protector hole and the second hollow beam hole.

The first fastener 42*a* and the second fastener 42*b* can be shear pins, cotter keys, wire wrap, hose wrap, clamp, bolts, nuts and washers, but not non-removable engagements, such as welding.

FIGS. 2A-2E depict a spring loaded purlin assembly according to one or more embodiments.

A plurality of spring loaded purlin assemblies 60*a*-60*f* are connected between the beams which are supported by spring loaded leg assemblies.

The spring loaded purlin assembly 60 can have a first tube 130, which can be flush mounted to a second tube 134 when in a compressed state.

Each first tube 130 and the second tube 134 of the spring loaded purlin assembly 60 can have an outer diameter from 2 inches to 4 inches. The first tube 130 and the second tube 134 can have tube walls with a thickness from one-eighth of an inch to one-half of an inch.

In embodiments, each of the first tube 130 and the second tube 134 can have a length from 20 inches to 40 inches. In embodiments, the first tube and the second tube can be different lengths.

The first tube 130 can have a first tube hole 131. The second tube 134 can have a second tube hole 135.

The diameters of the first tube hole 131 and the second tube hole 135 can range from one-fourth of an inch to three-fourths of an inch in diameter.

The first tube 130 can connect with the second tube 134. The first tube can be movable from a flush mounted position with the second tube 134 to a disengaged position with the second tube 134.

A purlin spring 136 is mounted in and affixed to the first tube on one end and the second tube on the other end.

A plurality of purlin impact protectors 140*a*-140*d* can be fastened around the portions of the first tube 130 and the second tube 134 and the contained purlin spring 136.

The purlin impact protectors can have the same dimensions as the leg impact protectors, and in some embodiments, the purlin impact protectors can be 2 feet long.

In embodiments, the purlin spring 136 can be made from carbon steel and can range in extended length from 12 inches to 48 inches.

The purlin spring 136 can have from 10 active coils to 50 active coils in total for each spring loaded purlin assembly 60.

Each purlin impact protectors 140*a*-140*d* can have a first purlin leg impact protector hole 141*a* and a second purlin leg impact protector hole 141*b*.

The first purlin leg impact protector hole 141*a* and the second purlin leg impact protector hole 141*b* can have diameters ranging from one-fourth of an inch to three-fourths of an inch and align with the first tube hole 131 and second tube hole 135.

In embodiments, the first purlin leg impact protector hole 141*a* and the second purlin leg impact protector hole 141*b* can be positioned 1.5 inches to 5 inches from an end of a first tube and a second tube.

A first bracket extension 137*a* can engage the first tube 130 on an end opposite each of the plurality of purlin impact protectors 140*a*-140*d*.

The first tube 130 can engage a first bracket extension 137*a*. The second tube can engage a second bracket extension 137*b*. Each bracket extension can engage a u-shaped bracket 169*a* and 169*b*.

Each u-shaped bracket can have a rod 171*a* for engagement, a plurality of purlin fasteners 142*a* and 142*b* that connect the purlin spring 136 through the plurality of purlin impact protectors 140*abcd*

In embodiments, a first purlin fastener 142*a* can pass through the second tube 134, second tube holes 135, the purlin impact protector hole 141*b* through the purlin impact protector optionally engaging an end of the purlin spring 136.

The second purlin fastener 142*b* can pass through the first tube 130, via the first tube hole 131 through two purlin impact protectors 140*d* and 140*c* via purlin impact protector holes 141*a*, optionally engaging an end of the purlin spring 136.

Figure 3A:
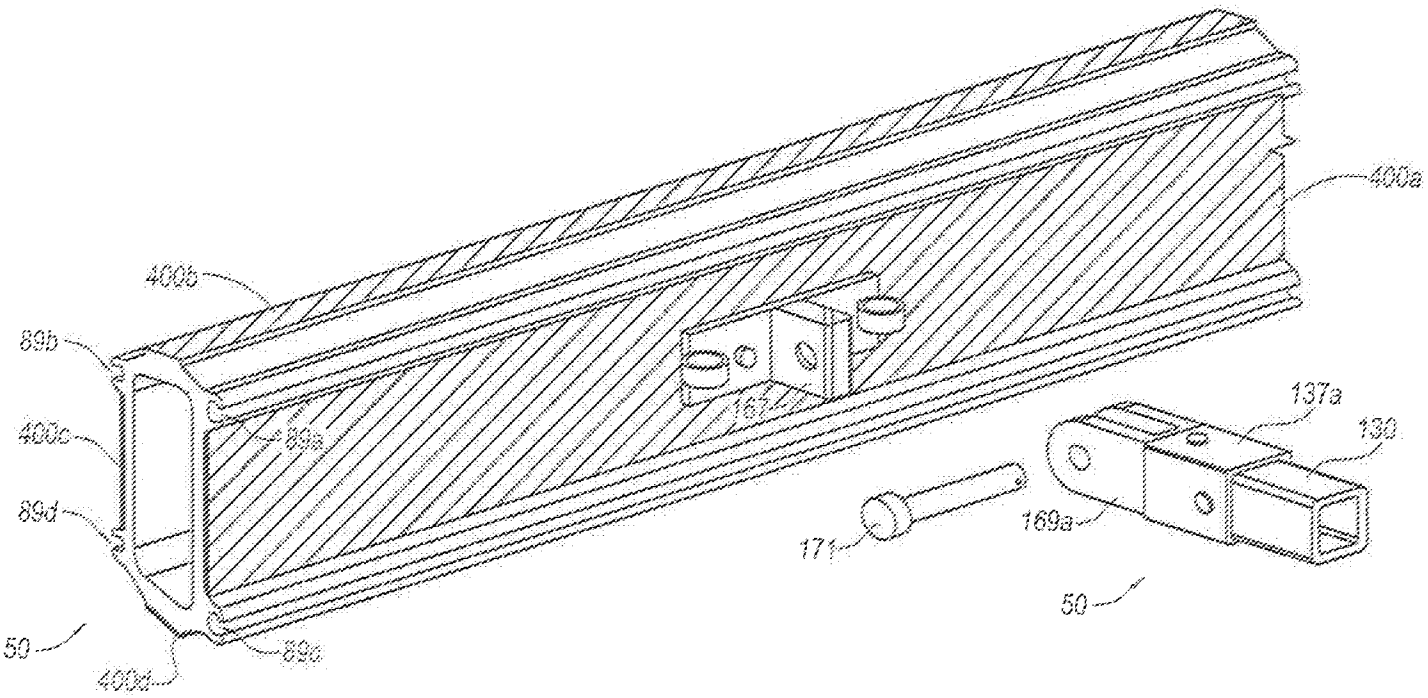
FIGS. 3A and 3B depicts a perspective view of a beam with a purlin bracket mounted thereto.
Figure 3B:
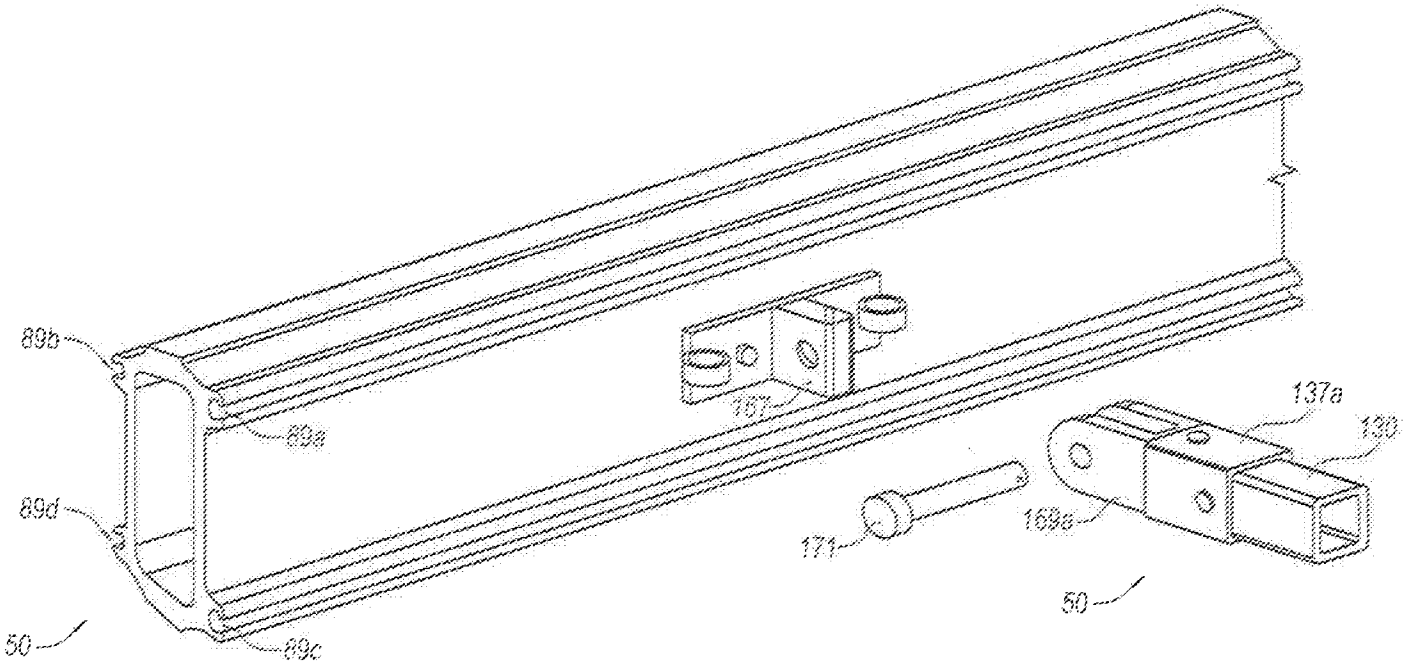

FIGS. 3A and 3B depict a purlin bracket 167 mounted to a beam 50 according to one or more embodiments.

The purlin bracket 167 can be affixed to a portion of a beam 50 between a top engagement groove 89*a* and a bottom engagement groove 89*c*.

In embodiments, the beam 50 can have one or more bottom engagement grooves 89*c* and 89*d*.

The purlin bracket 167 can engage the first u-shaped bracket 169*a* of the spring loaded purlin assembly 60.

In embodiments, the first u-shaped bracket 169*a* can engage the first bracket extension 137*a*, which can connect to the first tube 130 of the spring loaded purlin assembly 60.

A rod 171 can connect the first u-shaped bracket 169*a* to the purlin bracket 167.

In embodiments, the beam 50 can have a pair of top engagement grooves 89*a* and 89*b*. Each top engagement groove can extend from 0.5 inches to 4 inches laterally away from the beam 50.

The beam 50 can have a pair of bottom engagement grooves 89*c* and 89*d*. Each bottom engagement groove can extend 0.5 inches to 4 inches laterally away from the beam.

In embodiments, the beam 50 can have four engagement grooves for receiving pair of inside contiguous layers of ballistic protection material or pairs of outside contiguous layers of ballistic protection material.

The beam 50 can be hollow or solid, such as a solid plastic or fiberglass. In embodiments, the beam 50 can be formed from aluminum or carbon steel.

Each beam can have two or more beam impact protectors 400*a*, 400*b*, 400*c*, and 400*d*.

Figure 4:
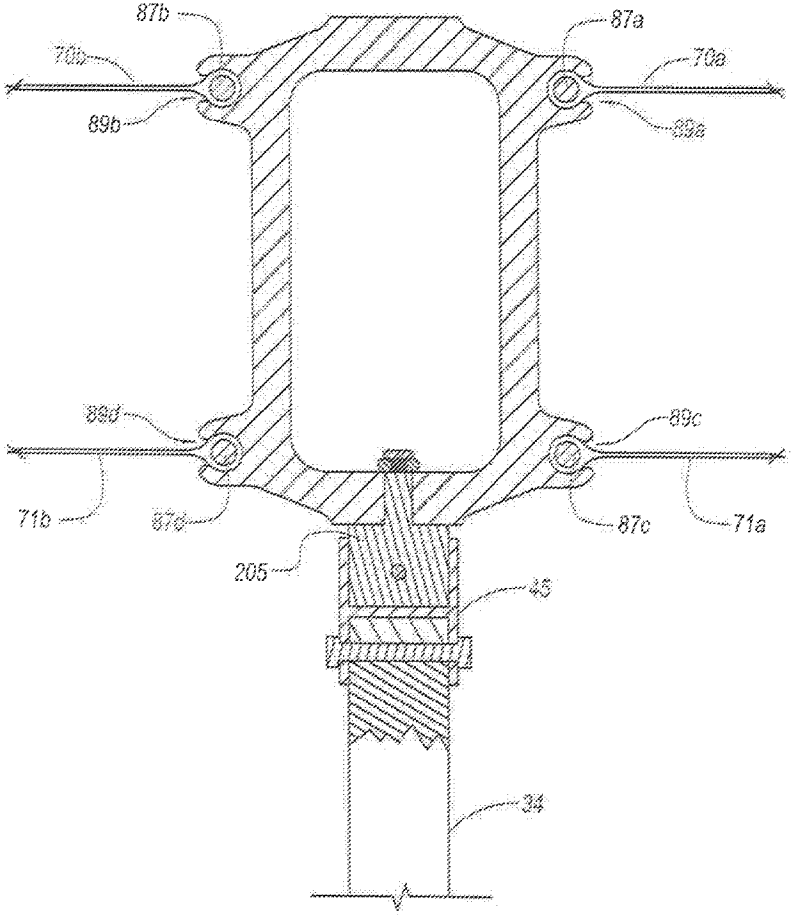
FIG. 4 depicts a cross section of a beam according to one or more embodiments.

FIG. 4 depicts a cross section of a beam according to one or more embodiments.

The beam 50 can engage a bolt 205, which can connect to the second bracket 45 of the second hollow beam 34 of the spring loaded leg assembly.

The beam 50 can support a pair of inside contiguous layers of ballistic protection material 70*a* and 70*b* wherein the plurality of inside contiguous layers of ballistic protection material connected in sequence, to each other between beams.

The beam 50 can support a pair of outside contiguous layers of ballistic protection material 71*a* and 71*b* forming a space between the dual layers of ballistic protection material. The dual layers of ballistic protection material are shown connected to each side of the beam 50.

Each inside contiguous layer of ballistic protection material connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure 5.

The plurality of outside contiguous layers of ballistic protection material is connected in sequence. Each outside contiguous layer of ballistic protection material mounted over the inner structure. Each outside contiguous layer of ballistic protection material connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure.

The inner and outer structures together form the ballistic protection shelter providing protection to shelter occupants against the blast overpressure, resulting from explosive detonations and shrapnel.

In this embodiment, an inside contiguous layer of ballistic protection material 70*a* is shown extending from a first connector 87*a* engaging a first engagement groove 89*a*.

In this embodiment, another inside contiguous layer of ballistic protection material 70*b* is shown extending from a second connector 87*b* engaging a second engagement groove 89*b*.

A first outside contiguous layer of ballistic protection material 71*a* is shown extending from a third connector 87*c* engaging a third engagement groove 89*c* of the beam.

A second outside contiguous layer of ballistic protection material 71*b* is shown extending from a fourth connector 87*d* engaging a fourth engagement groove 89*d*.

Pairs of contiguous layers of ballistic protection material can be connected in parallel from one of the beams to another of the beams forming a space between first and outside contiguous layers of ballistic protection material. Once placed over the beams, the contiguous layers of ballistic protection material can provide the appearance of a tent or similar structure, with the ballistic protection material adapted to provide protection to shelter occupants against blast overpressure, resulting from explosive detonations and shrapnel.

A usable fabric for the contiguous layer of ballistic protection material can be vinyl, KEVLAR™ sheets, canvas sheets, or composite sheets to include plastic and wire.

In embodiments, the fabric for contiguous layer of ballistic protection material can be coated with flame retardant materials.

Figure 5:
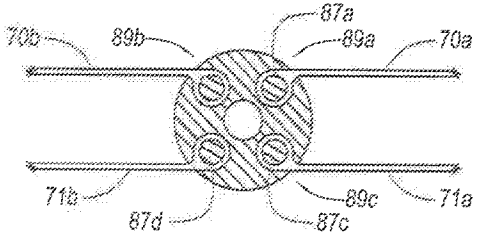
FIG. 5 is a cross sectional view of the beam with four engagement grooves according to one or more embodiments.

FIG. 5 is a cross sectional view of the beam according to one or more embodiments.

The beam 50 can engage a plurality of connectors 87*a*-87*d*, wherein at least one of the connectors can engage at least one of the engagement grooves 89*a*-89*d* of the beam 50 while simultaneously engaging a contiguous layer of ballistic protection material 70*a* or 70*b* or 71*a* or 71*b*.

Each connector 87*a*-87*d* can slidably engage one of the engagement grooves 89*a*-89*d* of a beam 50 while connected to the inside contiguous layer of ballistic protection material 70*a* or 70*b* or the outside contiguous layer of ballistic protection material 71*a* or 71*b*.

Figure 6:
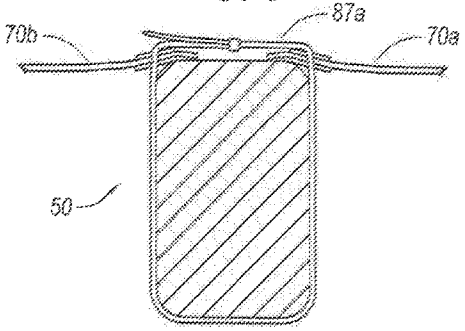
FIG. 6 is an end view of the beam with a connector according to one or more embodiments.

FIG. 6 is an end view of a beam 50 with a connector 87*a* according to one or more embodiments.

The beam 50 is shown with one connector 87*a* engaging two different inside contiguous layers of ballistic protection material 70*a* and 70*b*. The connector 87 can engage holes, VELCRO™ connectors, or grommets in the contiguous layers of ballistic protection material. The connector can be a tie wrap, wire, or rope.

Figure 7:
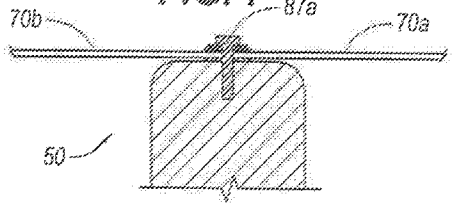
FIG. 7 is a detailed view of the beam with a connector according to one or more embodiments.

FIG. 7 is a detailed view of the beam 50 with a connector 87*a* according to one or more embodiments.

The beam 50 is shown engaging a connector 87*a* while simultaneously engaging two inside contiguous layers of ballistic protection material 70*a* and 70*b*. In this embodiment, the connector 87*a* is depicted as a bolt.

Figure 8:
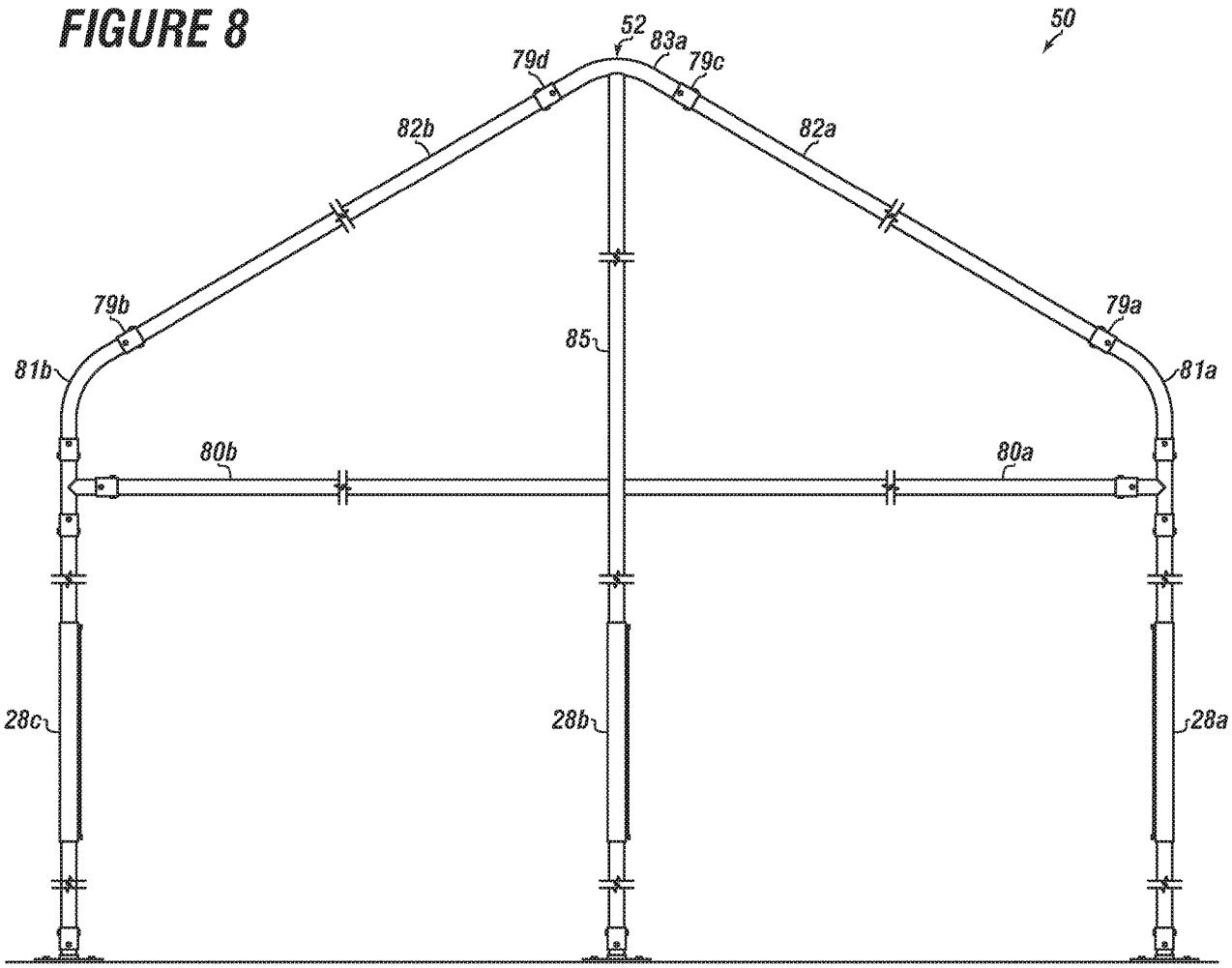
FIG. 8 is an end view of the beams connected to three spring loaded leg assemblies according to one or more embodiments.

FIG. 8 is end view of the beams connected to three spring loaded leg assemblies according to one or more embodiments.

The beam 50 can have a curved apex 52 in a first roof curve 83*a*. The first roof curve 83*a* can connect on one side to a first long straight member 82*a* and on an opposite side to a second long straight member 82*b*. The first roof curve 83*a* can connect to two grooveless splicers 79*c* and 79*d*.

The first long straight member 82*a* and the second long straight member 82*b* can connect to grooveless splicers 79*c* and 79*d* opposite the first roof curve 83*a*. The first long straight member 82*a* can engage a grooveless splicer 79*a* and the second long straight member 82*b* can engage a grooveless splicer 79*b*.

In embodiments, a grooveless splicer 79*a* can connect to a first base curve 81*a* and a grooveless splicer 79*b* can connect to a second base curve 81*b*.

In embodiments, two end cross members 80*a* and 80*b* can be used. The first end cross member 80*a* can be between the first base curve 81*a* and an end pole 85. The second end cross member 80*b* can be between the second base curve 81*b* and the end pole 85.

The beam 50 can connect to spring loaded leg assemblies 28*a* and 28*c*.

The end pole 85 can connects to spring loaded leg assembly 28*b*.

The end pole 85 can extend from the spring loaded leg assembly 28*b*, which can be mounted to the surface of the curved apex 52 of one of the beams on an end of the ballistic protection shelter.

Figure 9:
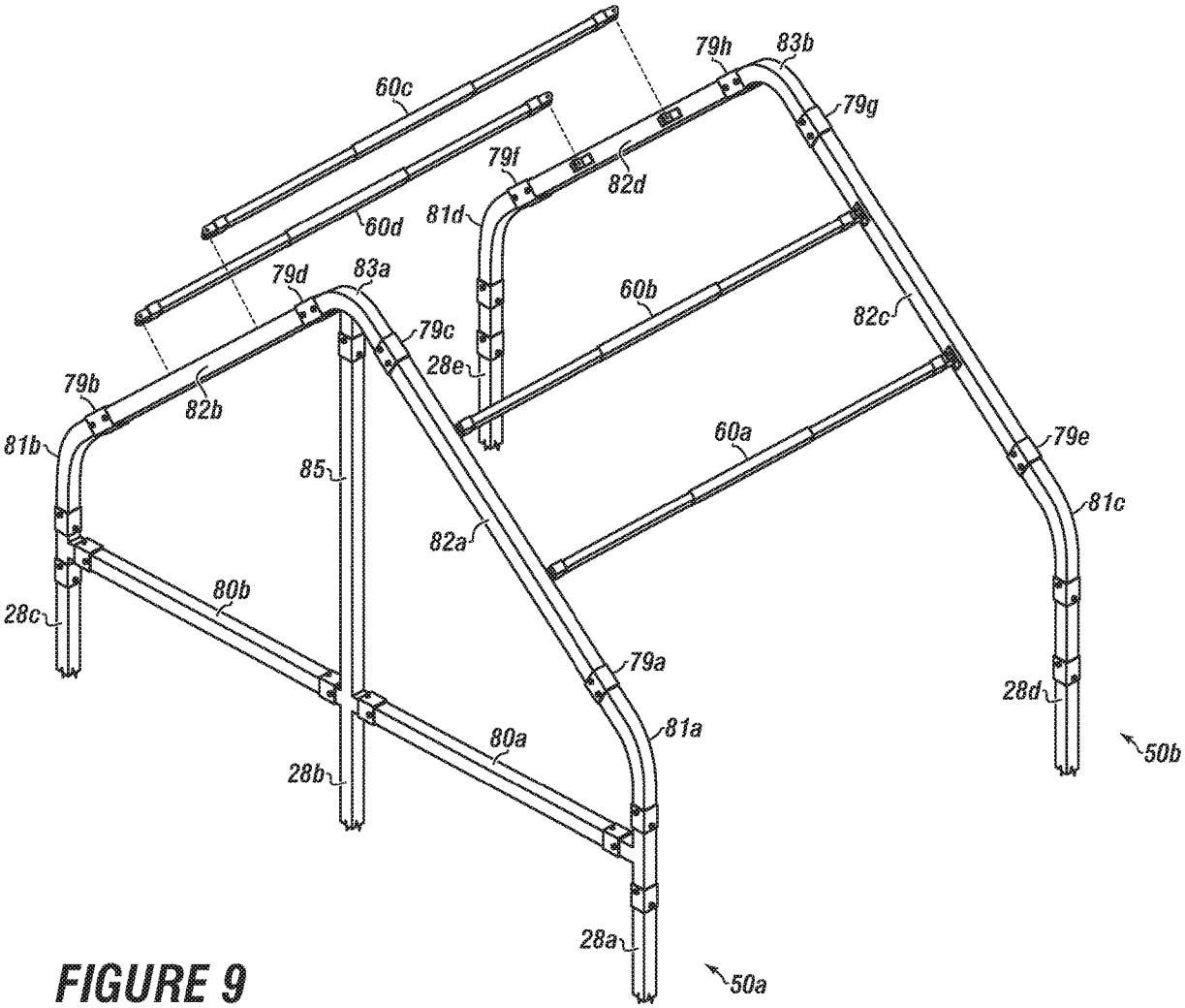
FIG. 9 is a top exploded view of a plurality of spring loaded purlin assemblies between two beams secured to a plurality of spring loaded leg assemblies according to one or more embodiments.

FIG. 9 is a top exploded view of a plurality of spring loaded purlin assemblies between two beams according to one or more embodiments.

Four spring loaded purlin assemblies 60*a*-60*d* are depicted connecting between the two beams 50*a* and 50*b*.

In embodiments, each spring loaded purlin assembly 28*a*-28*e* can engage one of the long straight members 82*a*-82*d* of each beam 50*a* and 50*b*.

The first and second spring loaded purlins 60*a* and 60*b* can connect a first long straight member 82*a* of a first beam 50*a* with a third long straight member 82*c* of the second beam 50*b*.

The third and fourth spring loaded purlins 60*c* and 60*d* can connect a second long straight member 82*b* of a first beam 50*a* with a fourth long straight member 82*d* of a second beam 50*b*.

The first beam 50*a* is shown having a first spring loaded leg assembly 28*a* connected to a first base curve 81*a* that engages a grooveless splicer 79*a* that further engages a first long straight member 82*a* that connects to a first roof curve 83*a*.

The first roof curve 83*a* can engage two grooveless splicers 79*c* and 79*d*.

In embodiments, the first beam 50*a* can have a second long straight member 82*b* mounted between the first roof curve 83*a* and a grooveless splicer 79*b*. The grooveless splicer 79*b* can engage a second base curve 81*b* that is supported by a third spring loaded leg assembly 28*c*.

An end pole 85 can connect the first roof curve 83*a* and to a second spring loaded leg assembly 28*b*.

In embodiments, a first end cross member 80*a* can be between the first base curve 81*a* and the end pole 85. A second end cross member 80*b* can be between the second base curve 81*b* and the end pole 85.

The second beam 50*b* can have a fourth spring loaded leg assembly 28*d* connected to a third base curve 81*c* optionally through a grooveless splicer 79*e*.

The grooveless splicer 79*e* can further engages a third long straight member 82*c* that connects to a grooveless splicer 79*g*. The grooveless splicer 79*g* can engage a second roof curve 83*b*.

The second roof curve 83*b* can connect to a grooveless splicer 79*h* that can further connect to a fourth long straight member 82*d*.

The long straight member 82*d* can connect to grooveless splicer 79*f*. The grooveless splicer 79*f* can engage a fourth base curve 81*d*, which is supported by a fifth spring loaded leg assembly 28*e*.

FIGS. 10A-10D depict a plurality of configurations for structural support bars according to one or more embodiments.

Figure 10A:
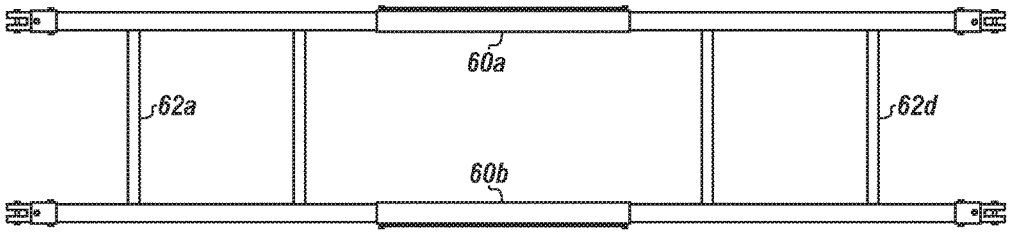
FIGS. 10A-10D depict a plurality of configurations for structural support bars usable between spring loaded purlin s according to one or more embodiments.
Figure 10B:
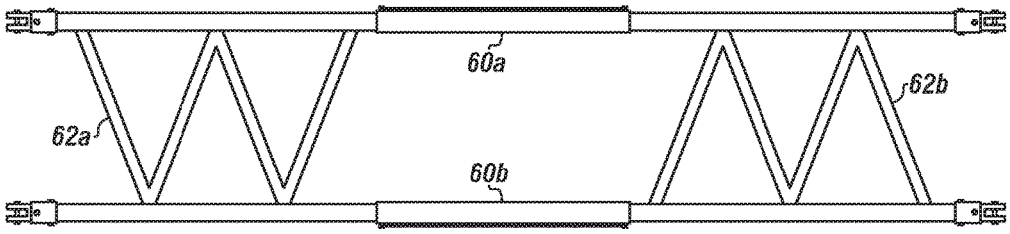
Figure 10C:
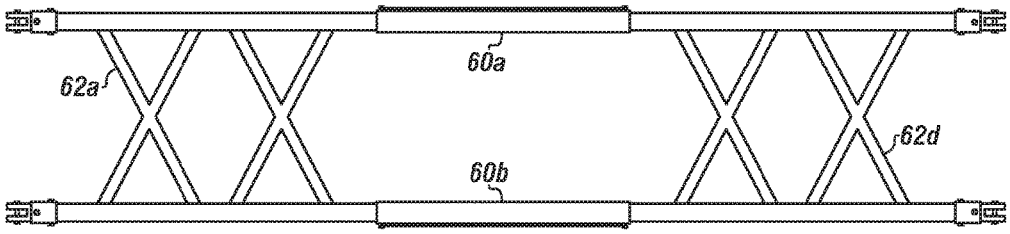
Figure 10D:
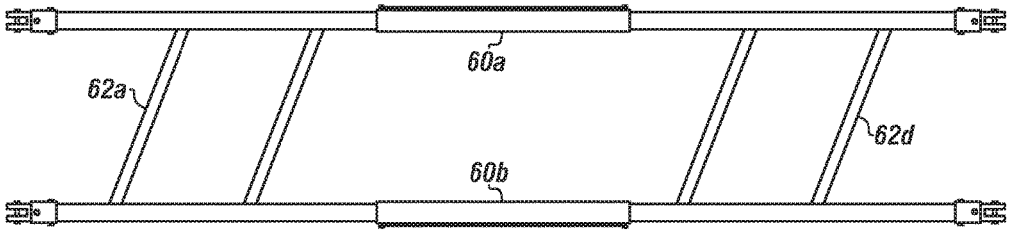

A plurality of structural support bars 62*a*-62*d* can be configured at different orientations to provide support between pairs of spring loaded purlin assemblies 60*a* and 60*b*. Configurations can be H shaped, as shown in FIG. 10A, W shaped or M shaped, as shown in FIG. 10B, XX shaped, as shown in FIG. 10C and in the form of diagonal supports in parallel, as shown in FIG. 10D.

Figure 11A:
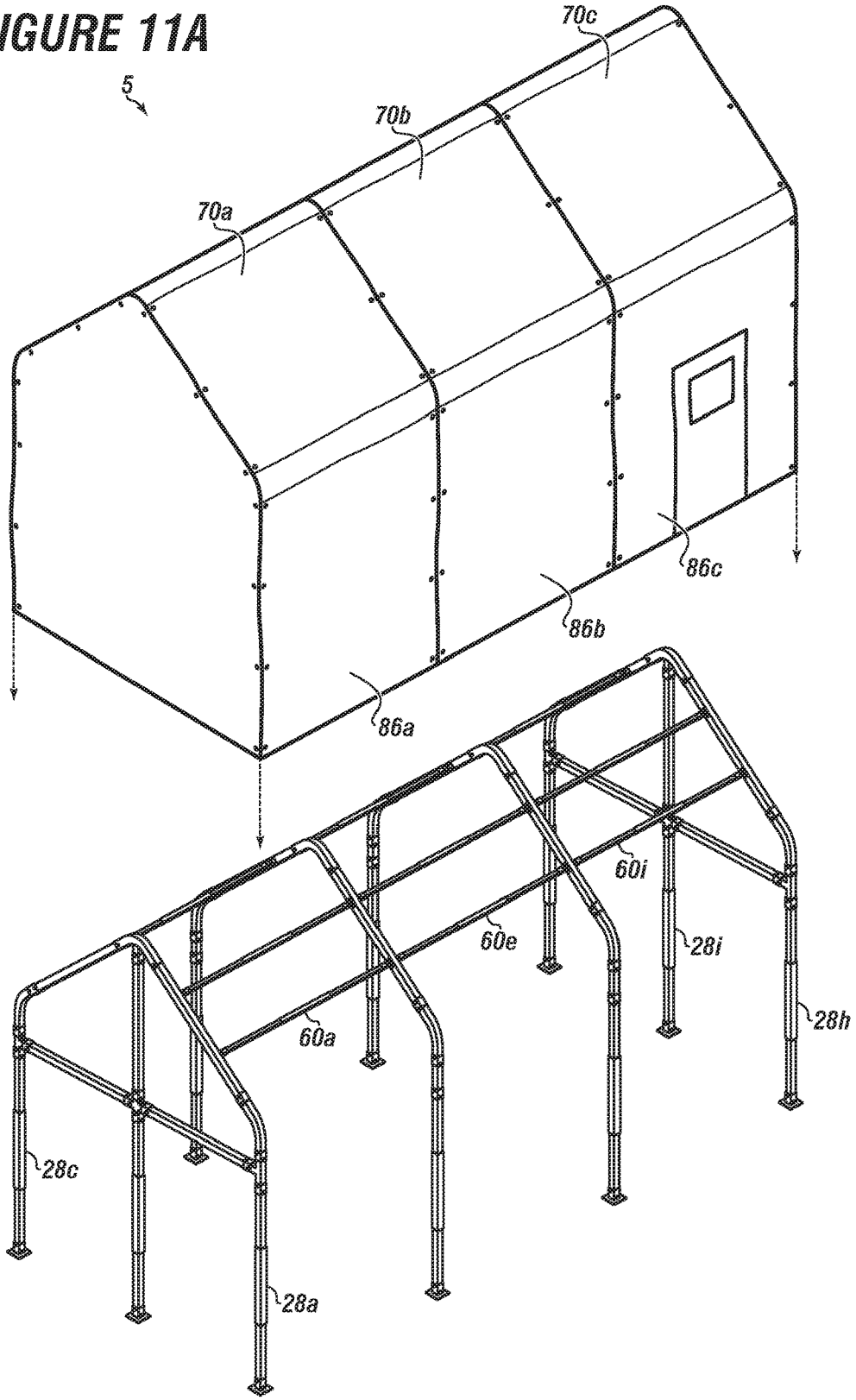
FIG. 11A depicts an exploded view of an inner structure that covers assembled beams connected to spring loaded leg assemblies with spring loaded purlins according to one or more embodiments.

FIG. 11A depicts an exploded view of an inner structure 5 that covers assembled beams connected to spring loaded leg assemblies with spring loaded purlins according to one or more embodiments. The inside contiguous layers of ballistic protection material 70*a*-70*c* mount over the beams as connected to spring loaded leg assemblies 28*a*-28*i*.

Spring loaded purlin assemblies 60*a*-60*i* can be mounted between pairs of beams.

In embodiments, the inner structure 5 can have a plurality of flexible ballistic protection material side walls 86*a*, and a door 186.

Figure 11B:
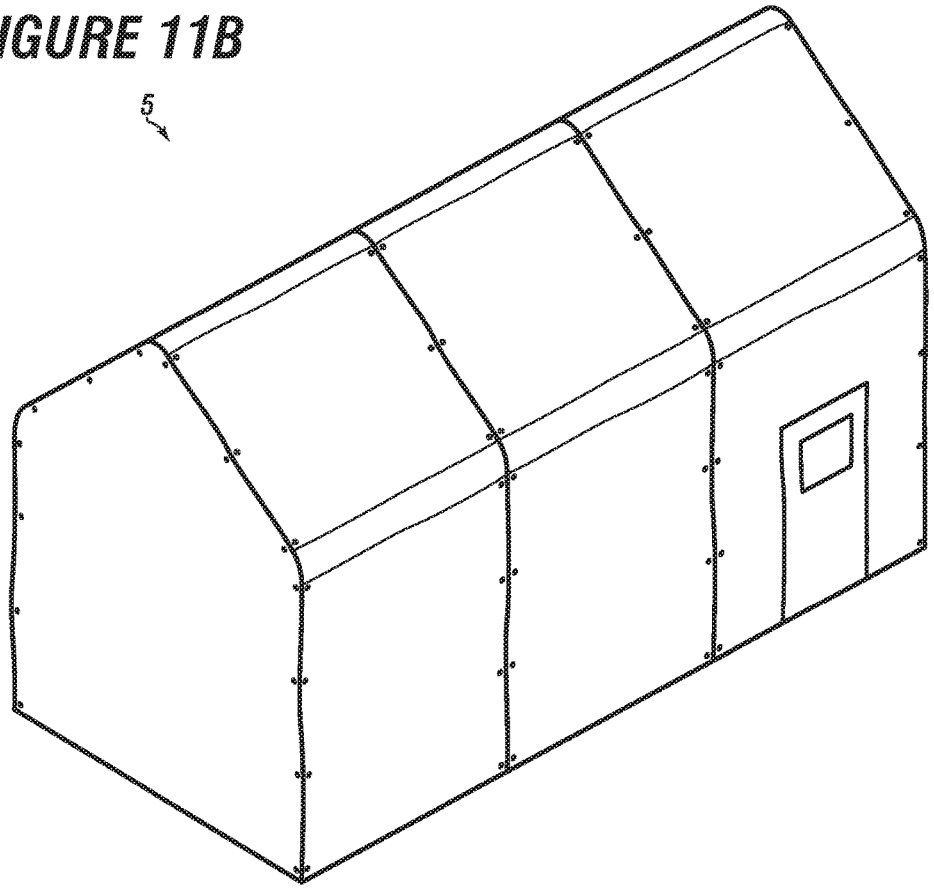
FIG. 11B depicts an outer structure that covers the inner structure that is positioned over assembled beams connected to spring loaded leg assemblies with spring loaded purlins.

FIG. 11B depicts an outer structure 7 that covers the inner structure that is positioned over assembled beams connected to spring loaded leg assemblies with spring loaded purlins. The outside contiguous layers of ballistic protection material 71*a*-71*c* mount over the inner structure.

In embodiments, the spring loaded leg assembly can be formed using, but is not limited to the following steps:

The steps can include drilling two leg impact protector holes in a sleeve, the leg impact protector holes having a spaced apart relationship.

The steps can include cutting a hollow beam into a first hollow beam and a second hollow beam.

The steps can include drilling a hollow beam hole into each first and second hollow beam ensuring the hollow beam holes align with the leg impact protector holes when the first and second hollow beams engage each other in a flush mount.

The steps can include sliding a leg spring into a portion of the first hollow beam and into a portion of the second hollow beam, sliding the first and second hollow beams together and sliding the sleeve over the two hollow beams and the leg spring and align the holes.

The steps can include using a fastener, such as a bolt, to connect one end of the leg spring to the sleeve and first hollow beam, and the other end of the leg spring to the sleeve and second hollow beam using the aligned holes.

The steps can include connecting one end of a cable to one of the fasteners, and the other end of the cable to the other fastener.

The steps can include installing fasteners, such as washers and nuts, onto each fastener to complete the spring loaded leg assembly.

Example 1

The invention has 10 spring loaded leg assemblies with each spring loaded leg assembly configured to mount to a cement surface with bolts.

Each spring loaded leg assembly has a base plate that is 3 feet by 1 foot.

Each spring loaded leg assembly has a first bracket connected to the base plate and a first hollow beam for engaging the first bracket.

The first hollow beam can be 12 feet long and have a width of 3 inches.

The first hollow beam has a pair of inner leg grooves and a pair of outer leg grooves, each groove can be ¼ inch in depth.

Each spring loaded leg assembly has a second hollow beam with a pair of inner leg grooves and a pair of outer leg grooves and each groove can be ¼ inch in depth.

The second hollow beam is movable from a flush mounted position to a disengaged position with the first hollow beam.

A spring loaded leg assembly is contained in a portion of the first hollow beam and a portion of the second hollow beam with an end of the leg spring connected to each hollow beam.

A plurality of leg impact protectors is mounted to surround the portions of each hollow beam containing the leg spring.

A second bracket is connected to the second hollow beam opposite the first hollow beam, wherein the first hollow beam and the second hollow beam compress the leg spring when the spring loaded leg assemblies are impacted by blast overpressure, resulting from explosive detonations and shrapnel.

The invention includes beams, wherein each beam is connected to the second bracket of one of the spring loaded leg assemblies.

Each beam has a pair of base curves, a roof curve forming a curved apex, and a pair of long straight members.

Each long straight member connects between one of the pair of base curves and the roof curve.

Each beam has a pair of top engagement grooves and a pair of bottom engagement grooves.

The invention includes a plurality of spring loaded purlin assemblies connected between the beams.

A plurality of inside contiguous layers of ballistic protection material is used to form the ballistic protection shelter.

The plurality of inside contiguous layers of ballistic protection material connects in sequence.

Each inside contiguous layer of ballistic protection material is connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure.

A plurality of outside contiguous layers of ballistic protection material is used to form the ballistic protection shelter.

The plurality of outside contiguous layers of ballistic protection material is connected in sequence.

Each outside contiguous layer is mounted over the inner structure.

Each outside contiguous layer is connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure.

The inner and outer structures together form the ballistic protection shelter providing protection to shelter occupants against the blast overpressure, resulting from explosive detonations and shrapnel.

Example 2

The invention has spring loaded leg assemblies with each spring loaded leg assembly configured to mount to a surface.

Each spring loaded leg assembly has a base plate, a first bracket connected to the base plate, and a first hollow beam for engaging the first bracket.

The first hollow beam has a pair of inner leg grooves and a pair of outer leg grooves.

Each spring loaded leg assembly has a second hollow beam with a pair of inner leg grooves and a pair of outer leg grooves.

The second hollow beam is movable from a flush mounted position to a disengaged position with the first hollow beam.

A leg spring is contained in a portion of the first hollow beam and a portion of the second hollow beam with an end of the leg spring connected to each hollow beam.

A plurality of leg impact protectors is mounted to surround the portions of each hollow beam containing the leg spring.

A second bracket is connected to the second hollow beam opposite the first hollow beam, wherein the first hollow beam and the second hollow beam compress the leg spring when the spring loaded leg assemblies are impacted by blast overpressure, resulting from explosive detonations and shrapnel.

The invention includes beams, wherein each beam is connected to the second bracket of one of the spring loaded leg assemblies.

Each beam has a pair of base curves, a roof curve forming a curved apex, and a pair of long straight members.

Each long straight member connects between one of the pair of base curves and the roof curve.

Each beam has a pair of top engagement grooves and a pair of bottom engagement grooves.

The invention includes a plurality of spring loaded purlin assemblies connected between the beams.

A plurality of inside contiguous layers of ballistic protection material is used to form the ballistic protection shelter.

The plurality of inside contiguous layers of ballistic protection material connects in sequence.

Each inside contiguous layer of ballistic protection material is connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure.

A plurality of outside contiguous layers of ballistic protection material is used to form the ballistic protection shelter.

The plurality of outside contiguous layers of ballistic protection material is connected in sequence.

Each outside contiguous layer is mounted over the inner structure.

Each outside contiguous layer is connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure.

The inner and outer structures together form the ballistic protection shelter providing protection to shelter occupants against the blast overpressure, resulting from explosive detonations and shrapnel.

Example 3

The invention has spring loaded leg assemblies with each spring loaded leg assembly configured to mount to a surface.

Each spring loaded leg assembly has a base plate, a first bracket connected to the base plate, and a first hollow beam for engaging the first bracket.

The first hollow beam has a pair of inner leg grooves and a pair of outer leg grooves.

Each spring loaded leg assembly has a second hollow beam with a pair of inner leg grooves and a pair of outer leg grooves.

The second hollow beam is movable from a flush mounted position to a disengaged position with the first hollow beam.

A leg spring is contained in a portion of the first hollow beam and a portion of the second hollow beam with an end of the leg spring connected to each hollow beam.

A plurality of leg impact protectors is mounted to surround the portions of each hollow beam containing the leg spring.

A second bracket is connected to the second hollow beam opposite the first hollow beam, wherein the first hollow beam and the second hollow beam compress the leg spring when the spring loaded leg assemblies are impacted by blast overpressure, resulting from explosive detonations and shrapnel.

The invention includes beams, wherein each beam is connected to the second bracket of one of the spring loaded leg assemblies.

Each beam has a pair of base curves, a roof curve forming a curved apex, and a pair of long straight members.

Each long straight member connects between one of the pair of base curves and the roof curve.

Each beam has a pair of top engagement grooves and a pair of bottom engagement grooves.

The invention includes a plurality of spring loaded purlin assemblies connected between the beams.

A plurality of inside contiguous layers of ballistic protection material is used to form the ballistic protection shelter.

The plurality of inside contiguous layers of ballistic protection material connects in sequence.

Each inside contiguous layer of ballistic protection material is connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure.

A plurality of outside contiguous layers of ballistic protection material is used to form the ballistic protection shelter.

The plurality of outside contiguous layers of ballistic protection material is connected in sequence.

Each outside contiguous layer is mounted over the inner structure.

Each outside contiguous layer is connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure.

The inner and outer structures together form the ballistic protection shelter providing protection to shelter occupants against the blast overpressure, resulting from explosive detonations and shrapnel.

While these embodiments have been described with emphasis on the embodiments, it should be understood that within the scope of the appended claims, the embodiments might be practiced other than as specifically described herein.

What is claimed is:

1. A ballistic protection shelter comprising:

a. spring loaded leg assemblies, each spring loaded leg assembly configured to mount to a surface, each spring loaded leg assembly comprising:
   (i) a base plate;
   (ii) a first bracket connected to the base plate;
   (iii) a first hollow beam for engaging the first bracket, the first hollow beam having a pair of inner leg grooves and a pair of outer leg grooves;
   (iv) a second hollow beam with a pair of inner leg grooves and a pair of outer leg grooves, the second hollow beam movable from a flush mounted position to a disengaged position with the first hollow beam;
   (v) a leg spring is contained in a portion of the first hollow beam and a portion of the second hollow beam with an end of the leg spring connected to each hollow beam;
   (vi) a plurality of leg impact protectors mounted to surround the portions of each hollow beam containing the leg spring;
   (vii) a second bracket connected to the second hollow beam opposite the first hollow beam, wherein the first hollow beam and the second hollow beam compress the leg spring when the spring loaded leg assemblies are impacted by blast overpressure, resulting from explosive detonations and shrapnel;

b. beams each beam connected to the second bracket of one of the spring loaded leg assemblies, each beam comprising:
   (i) a pair of base curves;
   (ii) a roof curve forming a curved apex; and
   (iii) a pair of long straight members, each long straight member connected between one of the pair of base curves and the roof curve;
   (iv) a pair of top engagement grooves and; and
   (v) a pair of bottom engagement grooves;

c. a plurality of spring loaded purlin assemblies connected between the beams;

d. a plurality of inside contiguous layers of ballistic protection material, the plurality of inside contiguous layers of ballistic protection material connected in sequence, each inside contiguous layer of ballistic protection material is connected in sequence between a pair of inner leg grooves of a first pair of the spring loaded leg assemblies, a pair of bottom engagement grooves of a pair of beams, and a pair of inner leg grooves of a second pair of the spring loaded leg assemblies and beneath at least one spring loaded purlin assembly forming an inner structure; and e. a plurality of outside contiguous layers of ballistic protection material, the plurality of outside contiguous layers of ballistic protection material connected in sequence, each outside contiguous layer mounted over the inner structure, each outside contiguous layer connected in sequence between a pair of outer leg grooves of the first pair of the spring loaded leg assemblies, a pair of top engagement grooves of the pair of beams, and a pair of outer leg grooves of the second pair of spring loaded leg assemblies and over at least one spring loaded purlin assembly forming providing the appearance of an outer structure, the inner and outer structures together form the ballistic protection shelter providing protection to shelter occupants against the blast overpressure, resulting from explosive detonations and shrapnel.

2. The ballistic protection shelter of claim 1, comprising end cross members, each end cross member joining a pair of the spring loaded leg assemblies.

3. The ballistic protection shelter of claim 1, comprising end poles, each end pole extending from the spring loaded leg assemblies to the curved apex of one of the beams.

4. The ballistic protection shelter of claim 1, comprising flexible ballistic protection material side walls, each flexible ballistic protection material side wall for engaging an edge of the inside contiguous layer of ballistic protection material and the outside contiguous layer of ballistic protection material.

5. The ballistic protection shelter of claim 1, comprising connectors, each connector designed to engage a portion of one of the inside contiguous layer of ballistic protection material and the outside contiguous layer of ballistic protection material.

6. The ballistic protection shelter of claim 1, wherein each beam comprises a purlin bracket for engaging one end of each spring loaded purlin assembly.

7. The ballistic protection shelter of claim 1, wherein each spring loaded purlin assembly comprises: a first tube engageable with a second tube, the first tube movable from a flush mounted position to a disengaged position with the second tube, a purlin spring mounted in and affixed to the first tube on one end and the second tube on the other end, and a plurality of purlin impact protectors fastened around the portions of the first tube and the second tube containing the purlin spring.

8. The ballistic protection shelter of claim 7, wherein the first tube engages a first bracket extension, the second tube engages a second bracket extension, each bracket extension engages a u-shaped bracket, each u-shaped bracket has a rod for engagement, a plurality of purlin fasteners that connect the purlin spring through the plurality of purlin impact protectors.

9. The ballistic protection shelter of claim 1, comprising a plurality of structural support bars disposed between pairs of the spring loaded purlin assemblies.

10. The ballistic protection shelter of claim 1, comprising a plurality of grooveless splicers, each grooveless splicer mounted between a base curve of the pair of base curves, the roof curve, and a long straight member of the pair of long straight members.

* * * * *